United States Patent [19]

Beall et al.

[11] 4,311,196

[45] Jan. 19, 1982

[54] TANGENTIALLY LOADED SLIP ASSEMBLY

[75] Inventors: Clifford H. Beall, Broken Arrow, Okla.; Albert A. Mullins, II, Humble, Tex.

[73] Assignee: Baker International Corporation, Orange, Calif.

[21] Appl. No.: 168,962

[22] Filed: Jul. 14, 1980

[51] Int. Cl.[3] ..... E21B 33/129

[52] U.S. Cl. ..... 166/134; 166/271

[58] Field of Search ..... 166/134, 137, 138, 139, 166/140, 216, 217, 209, 210, 86, 88

[56] References Cited

U.S. PATENT DOCUMENTS

| | | | |
|---|---|---|---|
| 2,061,289 | 11/1936 | Phipps | 166/138 |
| 2,382,455 | 8/1945 | Turechek | 166/134 |
| 2,546,377 | 3/1951 | Turechek | 166/134 |
| 3,818,988 | 6/1974 | Read | 166/140 |

*Primary Examiner*—James A. Leppink

*Attorney, Agent, or Firm*—William C. Norvell, Jr.

[57] ABSTRACT

An improved slip assembly is provided for grasping the interior wall of a well conduit to secure a tool against longitudinal movement. Interengaging means, such as upper and lower slip rings surround the tool and have T-shaped ears projecting from the opposed lower and upper ends of the upper and lower slip rings, respectively. Each ear cooperates with a T-shaped slot formed in a wider end of a wedge-shaped slip element to retain a plurality of such slip elements in side-by-side relationship about the periphery of the tool. At least one of the slip elements has wickers or teeth formed on the outwardly facing surface thereof. Movement of a setting means forces the upper slip elements in a direction with respect to the lower slip elements such that the slip elements are forced outwardly until the wickers engage the interior wall of the well conduit to secure the tool on the well conduit. When all of the slip elements are provided with wickers the slip assembly will provide 360° contact with the interior of the well conduit, which more evenly distributes the stress in the conduit at the point of slip contact.

33 Claims, 6 Drawing Figures

TANGENTIALLY LOADED SLIP ASSEMBLY

BACKGROUND OF THE INVENTION

1. Field of the Invention

The present invention relates to a slip assembly for anchoring a packer assembly or the like in a well bore.

2. Description of the Prior Art

Slip assemblies are utilized in downhole tools, such as packer assemblies, bridge plugs, liner hangers, and the like, to grasp the interior wall of a well conduit to secure or anchor the tool. Thus anchored, the tool cannot be moved longitudinally upward or downward with respect to the conduit.

One form of slip assembly is designed to be permanently anchored on the well conduit, such as that which is shown in U.S. Pat. No. 4,153,109 issued to A. J. Szescila. There is shown a packer having upper and lower slip assemblies. Each slip assembly surrounds the central body of the packer and has external teeth which are to engage the well casing. The lower slip assembly has an internal expander surface which tapers in an inward and downward direction and engages a companion externally tapered surface on a lower expander secured to the body of the packer by one or more shear screws threaded in the expander and received within a peripheral groove in the body. The slip assembly has circumferentially spaced weakened sections formed therein such that relative downward shifting of the lower expander with the slip assembly causes the slip assembly to break at the weakened sections into a plurality of slip elements. These slip elements are then expanded outwardly into anchoring engagement with the well casing.

The upper end of the lower expander bears against a packing surrounding the tool body and the upper end of the packing bears against the lower end of an upper expander having a tapered surface inclined in an upward and inward direction. The tapered surface engages a companion internal tapered surface in an upper slip ring which also has weakened sections. The upper slip ring breaks into slip segments upon relative upward wedging of the upper expander within the slip assembly. These segments then shift outwardly into anchoring engagement with the wall of the well casing, or other conduit. Thus, the packer is permanently anchored with the upper slip segments preventing upward movement and the lower slip segments preventing downward movement.

Oftentimes, it is necessary or desirable to run and emplace within such a conduit a well tool which, upon completion of a remedial or other activity, may be retrieved from such emplacement, for subsequent reuse. Such a tool will, of necessity, require the use of an anchoring means, such as a slip assembly, which may be disengaged from anchoring position relative to the conduit.

One disadvantage of both permanent and retrievable prior art slip assemblies is that the tool being anchored is radially loaded. The slip segments bear against the expanders which, in turn, bear against the tool body. Such loading can deform the expanders and/or the tool body. The present invention provides a slip assembly which, when shifted to the set position, the slip elements do not bear on an expander ring. Instead, the slip elements bear against each other in the tangential direction. Therefore, the radial loading problems associated with the prior art slip assemblies are substantially eliminated by the present invention.

Upon removal from the well, the slip assembly of this invention is ready for re-insertion and reuse, if provided in the preferred retrievable form.

SUMMARY OF THE INVENTION

The present invention concerns a slip assembly for grasping the interior wall of a well conduit to secure a tool against longitudinal movement. Interengaging means, such as upper and lower slip rings surround the tool and carry a plurality of slip elements in side-by-side relationship. Each slip element is wedge-shaped with a wider end, a narrower end, and sides tapering between the ends. A T-shaped slot is formed in the wider end of each slip element for cooperation with one of a plurality of T-shaped ears formed on the lower end of the upper slip ring and the upper end of the lower slip ring. The ears are spaced such that the slip elements attached to the upper slip ring alternate with the slip elements attached to the lower slip ring. In one form, each slip element has a plurality of wickers or circumferentially extending teeth formed in its outwardly facing surface for engaging the interior wall of the well casing, or other conduit.

As the tool and the slip assembly are lowered into the well, the slip rings are positioned axially apart at a maximum spacing such that there is clearance between the wickers and the conduit interior wall. When the tool is to be secured, setting means are activated so that the upper slip ring and the attached slip elements are shifted with respect to the lower slip ring and attached slip elements to urge the slip elements toward engaging position relative to the conduit. Since the sides of the slip elements are in contact, all of the slip elements are concurrently forced radially outwardly and the wickers are urged into contact with the interior wall of the well conduit, such contact substantially evenly distributing the stress in the well conduit at the point of slip contact, and the slip elements bear against one another in the tangential direction.

When it is desired to release the slip assembly, the setting means moves the upper and lower slip rings away from one another. Such movement also shifts the upper slip elements with respect to the lower slip elements and all of the slip elements can move inwardly to disengage the wickers from the interior wall of the well conduit. One of the slip elements can be formed without wickers and cooperate with one of the slip rings to release before the other slip elements to reduce the radial pressure and the force required to release the other slip elements. Furthermore, the shape of the wickers can be designed to aid in the grasping of the conduit and the release of the slip elements, to hold in one, or both, longitudinal directions.

DESCRIPTION OF THE PREFERRED EMBODIMENTS

Figure 1:
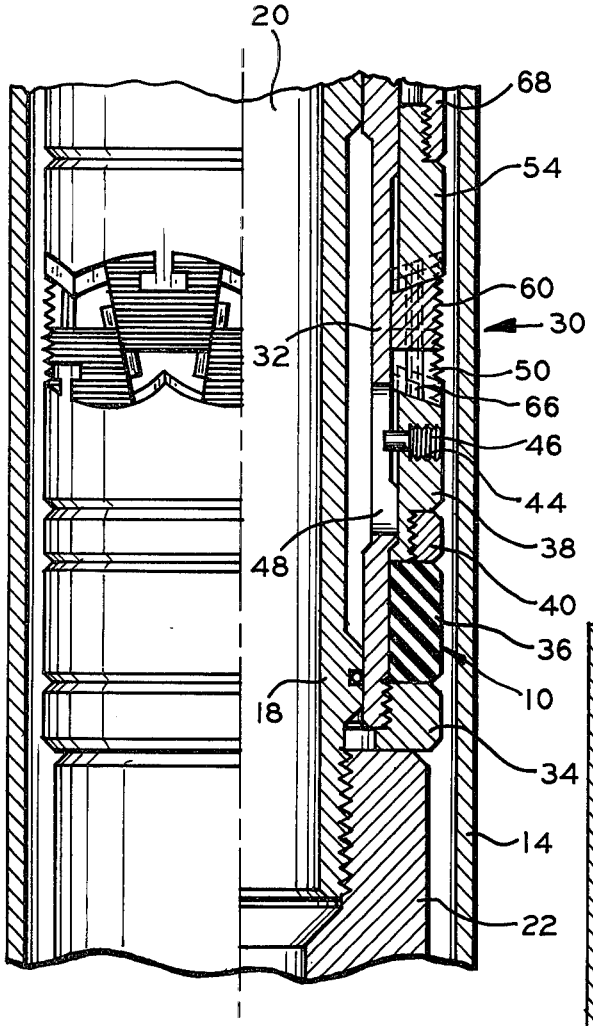
FIG. 1 is a combined side elevational view and longitudinal section through a well casing, a portion of a well packer and a slip assembly.
Figure 2:
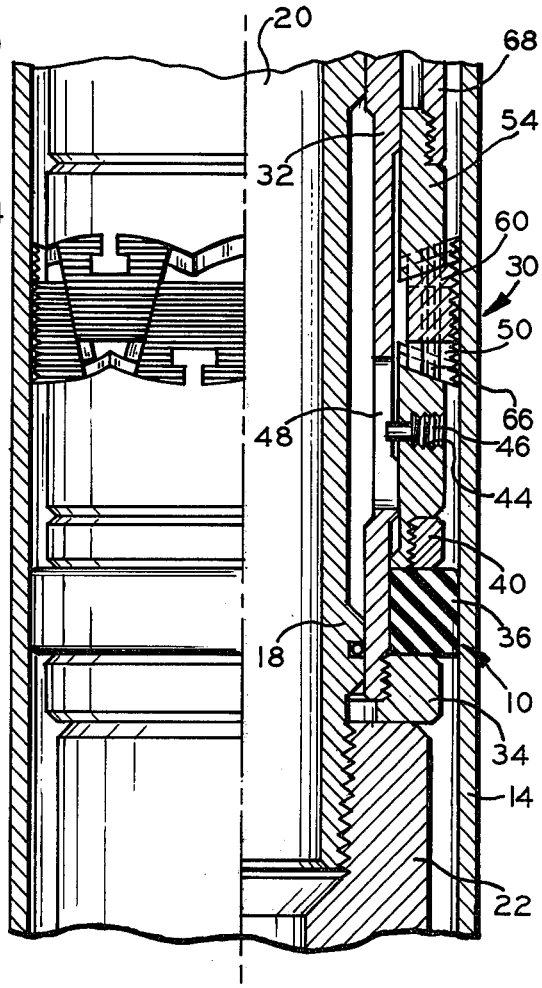
FIG. 2 is a longitudinal section showing the slip assembly of FIG. 1 in the anchored position.

As shown in FIGS. 1 and 2, the slip assembly is shown as part of a well packer, but it will be appreciated that this illustration is for exemplary purposes, since the slip assembly can be utilized in a number of different well tools. As shown in FIGS. 1 and 2, a well packer 10 of conventional and known design is secured to the lower end of a conduit, such as production tubing, a work string, wireline, or the like. The packer 10 is run into the well to a desired depth in a well casing 14 disposed in the well bore and is activated by a setting means (not shown) in a known manner.

The packer 10 has a central body 18 with a longitudinal passage 20 extending therethrough which may be used for transmission of hydraulic pressure, if the packer 10 is designed to be set hydraulically. A guide 22 is threadably secured to the lower end of the body 18 and may define the lowermost end of the packer 10, or it may be secured to a tubular conduit extension, or other element (not shown). A slip assembly 30 surrounds the body 18 of the packer 10.

Figure 3:
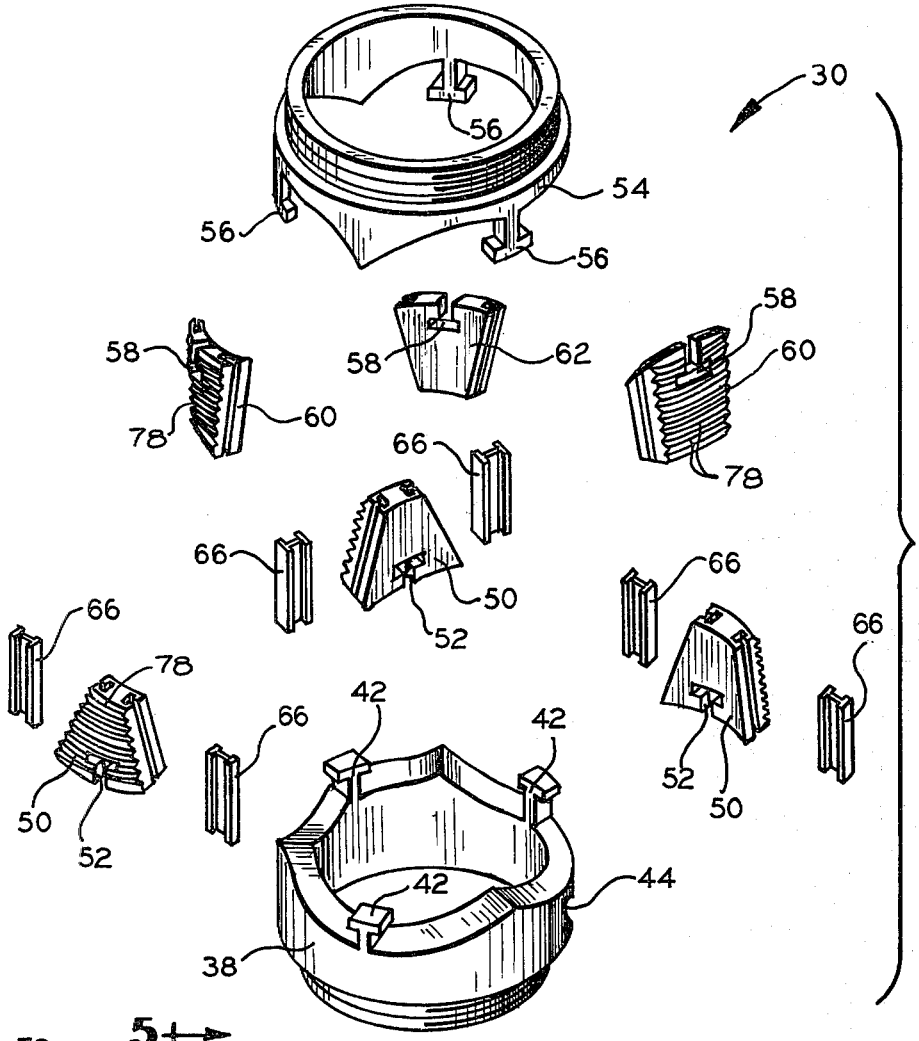
FIG. 3 is an enlarged perspective view of the slip assembly of FIGS. 1 and 2.

FIG. 1 shows the slip assembly before it is set, FIG. 2 shows the slip assembly in the set position secured to the wall of the casing, and FIG. 3 is an enlarged perspective view of the slip assembly. An inner sleeve 32 surrounds the central body 18 and provides a mounting surface for the elements of the slip assembly. A ring 34 is threaded onto the lower end of the sleeve 32 and rests upon the shoulder formed by the upper end of the guide 22 which prevents downward movement of the inner sleeve 32 with respect to the body 18.

The lower end of a packing 36 bears against the upper end of the ring 34 and the upper end of the packing 36 bears against the lower ends of a lower slip ring 38 and a retaining ring 40. The retaining ring 40 is threaded onto the lower end of the lower slip ring 38. The slip ring 38 has three upwardly projecting T-shaped ears 42 formed on the upper end thereof and a threaded hole 44 formed in the sidewall thereof. The threaded hole 44 receives a threaded pin 46 which extends through the slip ring and into a slot 48 formed in the inner sleeve 32 to prevent rotation of the slip elements on the sleeve 32.

Each of the ears 42 engages a T-shaped slot 52 formed in the wider end of one of a plurality of wedge-shaped lower slips 50. The slips 50, which are annular segments, have a plurality of circumferentially extending wickers or teeth 78 formed on the outwardly facing surfaces thereof for engaging the inner wall of the casing, or other conduit, 14 as shown in FIG. 2.

The lower slips 50 are equally spaced about the lower slip ring 38 and extend upwardly between adjacent ones of a plurality of upper slips connected to an upper slip ring 54. The upper slip ring 54 has three downwardly projecting T-shaped ears 56 formed on the lower end thereof. Each of the ears 56 engages a T-shaped slot 58 formed in the wider end of one of the plurality of wedge-shaped upper slips. Two of the upper slips 60 are substantially identical to the lower slips 50. A third upper slip 62 (FIG. 3) is shown as having no wickers or teeth formed on its outwardly facing surface, but may be so provided. The slip 62 functions as a releasing wedge, releasing first to reduce the load on the wickered slips 50 and 60, hence, this slip 62 may be provided in the form shown in FIG. 3.

Each of the slips 50, 60 and 62 has an axially extending T-shaped slot 76 formed along each side thereof. The slots 76 cooperate to respectively retain the sides of a plurality of H-shaped slip links 66. Thus, upon relative movement between the upper slip ring 54 and the lower slip ring 38, the slips 50, 60 and 62 are held in circumferential relationship by the slip links 66 as they are moved along the longitudinal axis of the packer assembly 10.

The upper end of the upper slip ring 54 is threaded into or may otherwise be engaged by the lower end of a setting means, such as sleeve 68. As the setting sleeve 68 is forced downwardly by conventional mechanism from its position in FIG. 1 to its set position in FIG. 2, the slip assembly is also forced downwardly to compress the packing 36 against the ring 34. The packing is expanded radially into sealing engagement with the casing wall 14 and the inner sleeve 32 which, in turn, is sealed to the packer assembly body 18 by a plurality of O-rings. The upper slips 60 and the releasing wedge slip 62 are forced downwardly with respect to the lower slips 50. This relative movement of the slips forces all of the slips outwardly into anchoring engagement with the wall of the well casing 14 as shown in FIG. 2. Thus, the slip assembly 30 anchors the packer 10 in the well casing 14.

When it is desired to release the slip assembly 30, the setting means, such as the sleeve 68 is moved upwardly relative to the inner sleeve 32. The releasing wedge slip 62 has no wickers and, therefore, requires less force to pull it from engagement with the wall of the casing 14. Furthermore, the T-shaped slot in the releasing wedge 62 can be formed with less vertical clearance such that the corresponding T-shaped ear 56 is the first to apply the releasing load, thereby moving the slip 62 first. The initial upward movement of the slip 62 releases the side loads on the other slips making it easier to pull them to their released positions.

Figure 4:
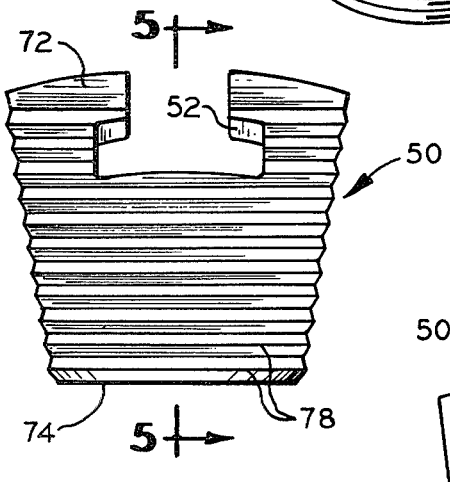
FIG. 4 is a front elevational view of a tangential slip according to the present invention.
Figure 6:
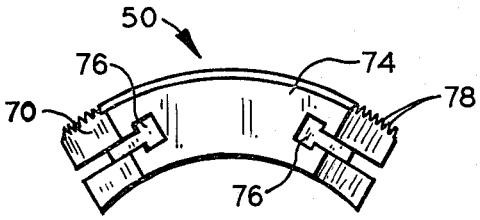
FIG. 6 is a bottom plan view of the tangential slip shown in FIG. 4.
Figure 5:
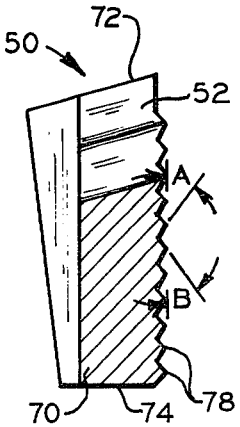
FIG. 5 is a cross-sectional view taken along the line 5—5 of FIG. 4.

The tangential slip 50, shown in FIGS. 4 through 6, is representative of the lower slips 50, the upper slips 60, and the releasing wedge slip 62. The slip 50 has an arcuate shaped body 70 which tapers from a wider end 72 to a narrower end 74. The T-shaped slot 52 is formed in the wider end 72. A pair of T-shaped slots 76 extend from the wider end 72 to the narrower end 74 along the side faces of the body 70 to accept the slip links 66. The outwardly facing surface of the body 70 has a plurality of wickers or teeth 78 formed thereon.

The wickers 78 extend between the side faces of the body 70 in parallel relationship. The wicker profile is defined by a pair of angles A and B which represent the inclination of the wicker surfaces with respect to the outwardly facing surface of the body 70. The angle B defines the inclination of the wicker surface facing the wider end 72 and the angle A defines the inclination of the wicker surface facing the narrower end 74. In FIG. 5, the angles A and B are shown as being approximately equal to 37°. However, other combinations of angles can be utilized to achieve any desired result. For example, if angle A is 60° and angle B is 30°, the slip may release easier than the slip shown in the drawings. Furthermore, it is an advantage of the present invention that the wickered slips can be identical.

Although the present invention has been illustrated with a setting sleeve attached to the upper slip ring, it can also be set by actuating the lower slip ring or both slip rings. Any well known setting device, either hydraulically, mechanically, or pneumatically, or wire or electric line may be used.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for securing a tool to the interior wall of a conduit in a subterranean well, comprising: a plurality of wedge-shaped arcuate slip elements spaced about the periphery of the tool in side-by-side relationship, each of said slip elements tapering from a wider end to a narrower end along the longitudinal axis of the conduit in the well bore, at least one of said slip elements having an outwardly facing annular segment surface for cooperation with the interior wall of the conduit in the well bore and extending between said wider and narrower ends; means for cooperatively interengaging said slip elements with the tool for radial and longitudinal movement with respect to the tool; and setting means for relatively moving said slip elements along the longitudinal axis of the tool and toward said interior wall to force said slip elements radially outwardly and to engage said outwardly facing surfaces onto the interior wall of the conduit to secure the tool against longitudinal movement in at least one direction, whereby said slip elements bear against one another in a tangential direction and distribute thereacross stress in the conduit at the point of contact with said outwardly facing surfaces.

2. The apparatus of claim 1 wherein all but one of said slip elements have an outwardly facing annular segment surface for cooperation with the interior wall of the conduit.

3. The apparatus of claim 1 wherein all of said slip elements have an outwardly facing annular segment surface for cooperation with the interior wall of the conduit.

4. The apparatus of claim 1, 2 or 3 wherein said slip elements has a plurality of circumferentially extending wickers formed on said outwardly facing surface thereof for engaging the interior wall of the well bore.

5. The apparatus of claim 1, 2 or 3 wherein said means for cooperatively interengaging said slip elements includes ring means surrounding the tool, one of the ring means and said slip elements having a plurality of T-shaped ears formed thereon and wherein the other of the ring means and the said slip elements has a T-shaped slot formed thereon for retaining one of said T-shaped ears permitting radial movement of said slip elements with respect to the longitudinal axis of the tool.

6. The apparatus of claim 1, 2 or 3 wherein said means for cooperatively interengaging said slip elements includes a ring means surrounding the tool, one of the ring means and said slip elements having a plurality of T-shaped ears formed thereon and wherein the other of the ring means and said slip elements has a T-shaped slot formed thereon for retaining one of the said T-shaped ears for radial movement of said slip elements with respect to the longitudinal axis of the tool as said slip elements and said ring means move longitudinally.

7. The apparatus of claim 1, 2 or 3 wherein said means for cooperatively interengaging said slip elements includes ring means surrounding the tool having a plurality of T-shaped ears formed thereon and wherein each of said slip elements has a T-shaped slot formed at said wider end thereof for retaining one of said T-shaped ears for radial movement of said slip elements with respect to the longitudinal axis of the tool.

8. The apparatus of claim 1, 2 or 3 wherein said means for cooperatively interengaging said slip elements includes ring means surrounding the tool having a plurality of T-shaped ears formed thereon and wherein each of said slip elements has a T-shaped slot formed at said wider end thereof for retaining one of said T-shaped ears for radial movement of said slip elements with respect to the longitudinal axis of the tool as said slip elements and said ring means move longitudinally.

9. The apparatus of claim 5 wherein said setting means cooperates with said ring means to actuate said ring means to shift said slip elements toward said interior wall.

10. The apparatus of claim 6 wherein said setting means cooperates with said ring means to actuate said ring means to shift said slip elements toward said interior wall.

11. The apparatus of claim 7 wherein said setting means cooperates with said ring means to actuate said ring means to shift said slip elements toward said interior wall.

12. The apparatus of claim 8 wherein said setting means cooperates with said ring means to actuate said ring means to shift said slip elements toward said interior wall.

13. An apparatus for securing a tool to the interior wall of a conduit within a well bore, comprising: a first plurality of wedge-shaped arcuate slip elements spaced about the periphery of the tool, each of said slip elements tapering from a wider end to a narrower end along the longitudinal axis of the conduit in the well bore, at least one of said slip elements having an outwardly facing arcuate surface for cooperation with the conduit in the well bore; means for cooperatively interengaging said first plurality of slip elements to the tool for radial and longitudinal movement with respect to the tool; a second plurality of wedge-shaped arcuate slip elements spaced about the periphery of the tool in side-by-side alternating relationship with said slip elements of said first plurality, each of said slip elements of said second plurality tapering from a wider end to a narrower end along the longitudinal axis of the conduit in the well bore in a direction opposite to the direction of taper of said first plurality of slip elements, at least one of said slip elements of said second plurality having an outwardly facing arcuate surface for cooperation with the conduit in the well bore; means for cooperatively interengaging said second plurality of slip elements to the tool for radial and longitudinal movement with respect to the tool; and setting means for selectively moving said first plurality of slip elements toward said second plurality of slip elements, whereby all said slip elements are concurrently forced radially outward and said outwardly facing surfaces engage the interior wall of the conduit to anchor the tool against at least one of upward and downward movement relative to said conduit, and whereby said slip elements bear against one another in the tangential direction and distribute thereacross stress in the conduit at the point of contact with said outwardly facing surfaces.

14. The apparatus of claim 13 wherein all but one of said slip elements of said first plurality of slip elements have an outwardly facing arcuate surface for cooperation with the conduit.

15. The apparatus of claim 13 wherein all of said slip elements of said first plurality of slip elements have an outwardly facing arcuate surface for cooperation with the conduit in the well bore.

16. The apparatus of claim 13 wherein all but one of said slip elements of said second plurality have an outwardly facing arcuate surface for cooperation with the conduit.

17. The apparatus of claim 13 wherein all of said slip elements of said second plurality have an outwardly facing arcuate surface for cooperation with the conduit.

18. The apparatus of claim 13 wherein each of said first and second plurality of slip elements has a plurality of circumferentially extending wickers formed on said outwardly facing surface thereof for engaging the interior wall of the well bore.

19. An apparatus for securing a tool to the interior wall of a conduit within a well bore, comprising: a first plurality of wedge-shaped arcuate slip elements spaced about the periphery of the tool, each of said slip elements tapering from a wider end to a narrower end along the longitudinal axis of the conduit in the well bore; means for cooperatively interengaging said first plurality of slip elements to the tool for radial and longitudinal movement with respect to the tool; a second plurality of wedge-shaped arcuate slip elements spaced about the periphery of the tool in side-by-side alternating relationship with said slip elements of said first plurality, each of said slip elements of said second plurality tapering from a wider end to a narrower end along the longitudinal axis of the conduit in the well bore in a direction opposite to the direction of taper of said first plurality of slip elements; means for cooperatively interengaging said second plurality of slip elements to the tool for radial and longitudinal movement with respect to the tool; setting means for selectively moving said first plurality of slip elements toward said second plurality of slip elements whereby all said slip elements are concurrently forced radially outward; and at least one of said slip elements of said first and second plurality has an essentially smooth, outer arcuate surface and the remainder of said slip elements in said first and second plurality each have a plurality of circumferentially extending wickers formed on the outwardly facing arcuate surface, and said outwardly facing arcuate surfaces engage the interior wall of the conduit to anchor the tool against at least one of upward and downward movement relative to said conduit, and whereby said slip elements bear against one another in the tangential direction and distribute thereacross stress in the conduit at the point of contact with said outwardly facing surfaces.

20. The apparatus of claim 19 further comprising means for axially shifting all slips having a smooth outer arcuate surface in a slip releasing direction prior to shifting the other slip elements.

21. The apparatus of claim 13, 19 or 20 wherein said means for cooperatively interengaging said slip elements of each of said first and second plurality includes ring means surrounding the tool, one of the ring means and said slip elements having T-shaped ear means formed thereon and wherein the other of the ring means and said slip elements has T-shaped slot means formed thereon for retaining a T-shaped ear means for radial movement with respect to the longitudinal axis of the tool.

22. The apparatus of claim 13, 19 or 20 wherein said means for cooperatively interengaging said slip elements of said first and second plurality includes ring means surrounding the tool and having a plurality of T-shaped ears formed thereon and wherein each of said slip elements of said first and second plurality has a T-shaped slot formed at said wider end thereof for retaining one of said T-shaped ears for radial movement of said slip elements with respect to the longitudinal axis of the tool as said slip elements and at least one of said ring means moves longitudinally.

23. The apparatus of claim 22 wherein said setting means cooperates with said ring means to actuate said ring means to shift said slip elements of said first and second plurality toward said interior wall.

24. A slip assembly for securing a tool to an interior wall of a well conduit, comprising: a plurality of wedge-shaped arcuate upper slip elements spaced about the periphery of the tool, each of said upper slip elements tapering from an upper wider end to a lower narrower end along the longitudinal axis of the well conduit and having an outwardly facing surface curved from side-to-side for cooperation with the interior wall of the well conduit and extending between said wider and narrower ends; an upper ring surrounding the tool above said upper slip elements and having a plurality of T-shaped ears formed thereon, each of said upper slip elements having a T-shaped slot formed at said wider end thereof for retaining one of said T-shaped ears for radial movement of said upper slip elements with respect to the longitudinal axis of the tool; a plurality of wedge-shaped arcuate lower slip elements spaced about the periphery of the tool in side-by-side alternating relationship with said upper slip elements, each of said lower slip elements tapering from a lower wider end to an upper narrower end along the longitudinal axis of the well conduit and having an outwardly facing surface curved from side-to-side for cooperation with the interior of the well conduit and extending between said wider and narrower ends; a lower ring surrounding the tool below said lower slip elements and having a plurality of T-shaped ears formed thereon, each of said lower slip elements having a T-shaped slot formed at said wider end thereof for retaining one of said T-shaped ears for radial movement of said lower slip elements with respect to the longitudinal axis of the tool; and setting means for cooperating with at least one of said upper and lower rings for selectively and relatively urging the ring and slip elements toward one another, whereby said upper and lower slip elements are forced radially outward and said outwardly facing surfaces engage the conduit to secure the tool, and whereby said slip elements bear against one another in the tangential direction and distribute thereacross stress in the conduit at the point of contact with said outwardly facing surfaces.

25. The slip assembly of claim 24 wherein at least one of said upper and lower slip elements has a plurality of circumferentially extending wickers formed on said outwardly facing surface thereof for engaging the interior wall of the well bore.

26. The slip assembly of claim 24 further comprising means for slidably interengaging adjacent ones of said upper and lower slip elements.

27. The slip assembly of claim 26 wherein said means for slidably interengaging includes a plurality of slip links having an H-shaped cross-section and wherein each of said upper and lower slip elements has a T-shaped slot extending the length of each side thereof for accepting a side of one of said slip links.

28. The apparatus of claim 24 wherein at least one of said upper or lower slip elements has an essentially smooth, outer arcuate surface, and the remainder of said slip elements each have a plurality of circumferentially extending wickers formed on its outwardly facing arcuate surface.

29. The apparatus of claim 28 further comprising means for axially shifting all slips having a smooth outer arcuate surface in a slip releasing direction prior to shifting the other slip elements.

30. A well tool adapted to be carried on a first conduit and within a second conduit in a subterranean well, comprising: a plurality of wedge-shaped arcuate slip elements spaced about the periphery of the tool in side-by-side relationship, each of said slip elements tapering from a wider end to a narrower end along the longitudinal axis of the second conduit in the well bore, at least one of said slip elements having an outwardly facing annular segment surface for cooperation with the interior wall of the second conduit in the well bore and extending between said wider and narrower ends; means for cooperatively interengaging said slip elements with the tool for radial and longitudinal movement with respect to the tool; and setting means for relatively moving said slip elements along the longitudinal axis of the tool and toward said interior wall to force said slip elements radially outwardly and to engage said outwardly facing surfaces onto the interior wall of the second conduit to secure the tool against longitudinal movement in at least one direction, whereby said slip elements bear against one another in the tangential direction and distribute thereacross stress in the second conduit at the point of contact with said outwardly facing surfaces.

31. A well tool adapted to be carried on a first conduit and within a second conduit in a subterranean well, comprising: a first plurality of wedge-shaped arcuate slip elements spaced about the periphery of the tool, each of said slip elements tapering from a wider end to a narrower end along the longitudinal axis of the second conduit in the well bore, at least one of said slip elements having an outwardly facing arcuate surface for cooperation with the second conduit in the well bore; means for cooperatively interengaging said first plurality of slip elements to the tool for radial and longitudinal movement with respect to the tool; a second plurality of wedge-shaped arcuate slip elements spaced about the periphery of the tool in side-by-side alternating relationship with said slip elements of said first plurality, each of said slip elements of said second plurality tapering from a wider end to a narrower end along the longitudinal axis of the second conduit in the well bore in a direction opposite to the direction of taper of said first plurality of slip elements, at least one of said slip elements of said second plurality having an outwardly facing arcuate surface for cooperation with the second conduit in the well bore; means for cooperatively interengaging said second plurality of slip elements with the tool for radial and longitudinal movement with respect to the tool; and setting means for selectively and relatively moving said first and second plurality of slip elements toward one another whereby all said slip elements are concurrently forced radially outward and said outwardly facing surfaces engage the interior wall of the second conduit to anchor the tool against at least one of upward and downward movement relative to said second conduit, and whereby said slip elements bear against one another in the tangential direction and distribute thereacross stress in the second conduit at the point of contact with said outwardly facing surfaces.

32. A packer assembly adapted to be carried on a first conduit and within a second conduit in a subterranean well, comprising: a packing element movable into sealing relationship with said conduit, and slip means comprising: a plurality of wedge-shaped arcuate slip elements spaced about the periphery of the tool, each of said slip elements tapering from a wider end to a narrower end along the longitudinal axis of the second conduit in the well bore and having an outwardly facing annular segment surface for cooperation with the interior wall of the second conduit in the well bore and extending between said wider and narrower ends; means for attaching said slip elements to the tool for radial and longitudinal movement with respect to the tool; a plurality of actuating elements spaced about the periphery of the tool, each of said actuating elements tapering from a wider end to a narrower end along the longitudinal axis of the second conduit in the well bore in a direction opposite the direction of taper of said slip elements; and setting means for relatively moving said slip elements along the longitudinal axis of the tool toward said actuating elements whereby said slip elements are forced radially outward and said outwardly facing surfaces engage the interior wall of the second conduit in the well bore to secure the tool, and whereby said slip elements bear against one another in the tangential direction.

33. A packer assembly adapted to be carried on a first conduit and within a second conduit in a subterranean well, comprising: a packing element movable into sealing relationship with said second conduit, and slip means comprising: a plurality of wedge-shaped arcuate slip elements spaced about the periphery of the tool, each of said slip elements tapering from a wider end to a narrower end along the longitudinal axis of the second conduit in the well bore and having an outwardly facing annular segment surface for cooperation with the interior wall of the second conduit in the well bore and extending between said wider and narrower ends; means for attaching said slip elements to the tool for radial and longitudinal movement with respect to the tool; a plurality of actuating elements spaced about the periphery of the tool, each of said actuating elements tapering from a wider end to a narrower end along the longitudinal axis of the second conduit in the well bore in a direction opposite the direction of taper of said slip elements; and setting means for relatively moving said slip elements along the longitudinal axis of the tool toward said actuating elements whereby said slip elements are forced radially outward and said outwardly facing surfaces engage the interior wall of the second conduit in the well bore to secure the tool, and whereby said slip elements bear against one another in the tangential direction.

* * * * *